US008430981B1

(12) United States Patent
Sczerzenie et al.

(10) Patent No.: US 8,430,981 B1
(45) Date of Patent: Apr. 30, 2013

(54) NICKEL-TITANIUM ALLOYS, RELATED PRODUCTS AND METHODS

(75) Inventors: Francis E. Sczerzenie, Piseco, NY (US); Alberto Coda, Gerenzano (IT)

(73) Assignee: Saes Smart Materials, New Hartford, NY (US)

( * ) Notice: Subject to any disclaimer, the term of this patent is extended or adjusted under 35 U.S.C. 154(b) by 0 days.

(21) Appl. No.: 13/562,066

(22) Filed: Jul. 30, 2012

(51) Int. Cl.
*C22F 1/10* (2006.01)
*C22C 19/03* (2006.01)

(52) U.S. Cl.
USPC ..... 148/563; 148/426; 420/460; 420/441

(58) Field of Classification Search ..... 148/563, 148/426; 420/441, 460
See application file for complete search history.

(56) References Cited

U.S. PATENT DOCUMENTS

| | | | | |
|---|---|---|---|---|
| 8,048,369 | B2 | 11/2011 | Forbes Jones et al. | |
| 8,152,941 | B2 | 4/2012 | Sczerzenie et al. | |
| 2001/0009981 | A1 * | 7/2001 | DuBois et al. | 600/585 |

FOREIGN PATENT DOCUMENTS

| | | |
|---|---|---|
| WO | 2005/049876 | 6/2005 |

OTHER PUBLICATIONS

ASM International, Materials Park, Ohio, Properties and Selection: Nonferrous Alloys and Special Purpose Materials: "Preparation and Chacterization of Pure Metals", Oct. 1990, vol. 2, pp. 1093-1097.*

C. M. Wayman, "Shape Memory Alloys" MRS Bulletin, Apr. 1993, pp. 49-56.

M. Nishida et al., "Precipitation Processes in Near-Equiatimic TiNi Shape Memory Alloys", Metallurgical Transactions A, vol. 17A, Sep. 1986, pp. 1505-1515.

H. Hosoda et al., "Martensitic transformation temperatures and mechanical properties of temary NiTi alloys with offstoichiometric compositions", Intermetallics, 6(1998), pp. 291-301.

* cited by examiner

*Primary Examiner* — Jessee R. Roe
(74) *Attorney, Agent, or Firm* — Steinfl & Bruno, LLP

(57) ABSTRACT

Ni-Ti (nickel-titanium) based alloys. and related semi-finished products and methods are described, where the nickel content is comprised between 50.7 and 52.0 atomic % .

15 Claims, No Drawings

NICKEL-TITANIUM ALLOYS, RELATED PRODUCTS AND METHODS

FIELD

The present disclosure relates to Ni-Ti (nickel-titanium) based alloys. It also relates to related Ni-Ti semi-finished products and methods. More particularly, it relates to Ni-Ti based alloys, related products and methods where the nickel content is comprised between 50.7 and 52.0 atomic % .

BACKGROUND

Ni-Ti alloys with a nickel content comprised between 40 and 52 atomic % pertain to the category of thermoelastic materials (also known in the field as Nitinol, Shape Memory Alloys, "smart" materials, etc). According to the finishing process these alloys undergo (e.g., training, shape setting, etc), they may exhibit a shape memory effect or a superelastic behavior. Details of suitable processes and characteristics of these alloys are widely known in the art and may be found, for example, in C. M. Wayman, "Shape Memory Alloys" MRS Bulletin, April 1993, 49-56, M. Nishida et al., "Precipitation Processes in Near-Equiatimic TiNi Shape Memory Alloys", Metallurgical Transactions A, Vol 17A, September, 1986, 1505-1515, and H. Hosoda et al., "Martensitic transformation temperatures and mechanical properties of ternary NiTi alloys with offstoichiometric compositions", Intermetallics, 6(1998), 291-301, all of which are herein incorporated by reference in their entirety.

These alloys are employed in a variety of applications. By way of example and not of limitation, in industrial applications, shape memory wires are used in actuators as a replacement for small motors. Further applications for such thermoelastic materials include the medical field, where they are used for stents, guidewires, orthopedic devices, surgical tools, orthodontic devices, eyeglass frames, thermal and electrical actuators, etc.

Independently from the final shape of the Ni-Ti thermoelastic device, which can, for example, be wire-, tube-, sheet- or bar-based, the manufacturing process includes a cutting phase from a longer metallic piece, obtained from a semi-finished product resulting from an alloy melting process as described, for example, in U.S. Pat. No. 8,152,941, assigned to the same assignee of the present application and incorporated herein by reference in its entirety. The most common forms for the semi-finished products are long tubes, wires, rods, bars, sheets.

The behavior of these Ni-Ti alloys is strongly dependent on their composition. The presence of one or more additional elements may result in new properties and/or significantly alter the characteristics and behavior of the alloy.

A way to improve the characteristics and properties of semi-finished product made with Ni-Ti alloys with the addition of controlled amounts of other elements has been addressed in the aforementioned U.S. Pat. No. 8,152,941. The purity of Ni-Ti alloys with respect to gaseous content has been addressed in international patent application number WO 2005/049876, also incorporated herein by reference in its entirety.

There is also a need to improve the characteristics of the Ni-Ti base alloy such as the alloy described in the ASTM standard F 2063, with particular reference to the alloy chemical composition as stipulated in Table 1 of F2063. These improvements lead to alloys with better properties and consequently to final devices with improved characteristics, especially in terms of fatigue resistance. As an example, improvements over the ASTM standard for a different type of alloy, Co-Cr-Mo are described in U.S. Pat. No. 8,048,369, also incorporated herein by reference in its entirety.

DESCRIPTION

According to a first aspect of the present disclosure, a Ni-Ti alloy is described, containing: between 55.75 and 57.0 wt % Ni, between 0.005 and 0.0220 wt % carbon, between 0.0001 and 0.0050 wt % nitrogen, between 0.0001 and 0,01 wt % aluminum, between 0.0001 and 0.,01 wt % silicon, between 0.0005 and 0.0220 wt % oxygen, the balance being titanium.

According to an embodiment of the present disclosure, the alloy can have one or more of its constituting elements defined according to the following subranges: aluminum comprised between 0.001 and 0.01 wt %, silicon comprised between 0.0003 and 0.01 wt %, oxygen comprised between 0.005 and 0.0220 wt %.

Differently from what disclosed and known in the art, with particular reference to the alloys made according to the already mentioned ASTM Standard F 2063, the applicants have found the critical role on the alloy performance played by elements not mentioned in the Standard, including aluminum and silicon, and have determined the useful percentage range of such elements, in order to keep the impact of their detrimental role under control, resulting in alloys with improved properties. Such improvements are based on a specific property of the alloy that is related to the control of microstructure when all of the above conditions are concurrently satisfied. It should be noted that such condition is not described in U.S. Pat. No. 8,152,941, which instead specifies levels for oxygen and carbon as high as 0.05 wt %, i.e. the same specification of the standard alloys for these two elements. In particular, the focus of U.S. Pat. No. 8,152,941 is on improving the properties of standard Nitinol by adding one or more additional elements at a relatively high level, rather than studying the requirements and effects of the addition and chemistry linked to the presence of low levels of carbon, oxygen and nitrogen as in the present disclosure.

The alloy according to the several embodiments of the present disclosure may be characterized by expressing its constituting elements in weight or atomic percentage. In order to provide a more direct comparison with the ASTM Standard alloy, the weight composition notation will be preferred with respect to the atomic ratio, since the first is the one used in the standard description. Such standard alloy, its features and characteristics are considered to be representative of the current state of the art for Ni-Ti alloys.

According to several embodiments of the present disclosure, the alloy composition exhibits a narrower range with respect to the two main elements constituting the alloy. In particular, nickel may vary from 55.75 to 57.0 wt %.

The ASTM Standard alloy does not provide sufficient emphasis with respect to the detrimental effect of oxygen and nitrogen. In particular, in the alloy according to the present disclosure the oxygen+nitrogen overall maximum content (0.027 wt %) is lower than the maximum content provided for in the standard (0.05 wt %). Additionally, more importance is given to the presence of nitrogen, while in the ASTM standard alloy oxygen and nitrogen are considered equivalent. In particular, in accordance with several embodiments of the present disclosure, the maximum level for nitrogen is much more stringent and set up to 0.0050 wt %. In particular, according to an embodiment of the present disclosure, wt % of oxygen is four to five times wt % of nitrogen.

Another difference between the alloy in accordance with the present disclosure and the standard alloy is provided by the maximum carbon content which, in the present disclosure, is up to 0.0220 wt %.

Therefore, as noted above, the alloy of the present disclosure is different from the known standard alloy due to a narrower composition range of its main elements, nickel and titanium, and in view of the concentration range for carbon, oxygen and nitrogen both as an overall content and as a single contribution.

In addition to such differences, the applicants have identified and recognized the role provided by the presence of aluminum and silicon, as well as the levels and intervals required to further enhance the characteristics of the alloy. It should be stressed that the role of aluminum and silicon is linked to the concurrent presence of carbon, oxygen and nitrogen in the amounts and/or relationships specified above.

The above conditions can allow solidification with eutectic precipitation of primary carbides in the interdendritic regions of the ingot structure, and a reduction of size, area fraction and particle density of intermetallic oxide inclusions.

Applicants have determined and quantified the key role, impact and relevance played by the concurrent presence of specified levels of aluminum and silicon in controlling nucleation and growth of intermetallic oxides during solidification and during subsequent hot working. The reduction of size, area fraction and particle density of such inclusions allows to improve the properties of the alloy and the performance of devices made with such alloys. In particular, a target achievable as a consequence of the teachings of the present disclosure is the provision of inclusions whose maximum size is 20 μm and 1.0% in density, intended as maximum normalized area fraction of the inclusions over the sampled/analyzed area. An even more desirable target achievable in accordance to the teachings of the present disclosure is the provision of inclusions whose maximum size is 12.5 nm and 0.5% in density.

Various melting processes can be employed to obtain the Ni-Ti alloy according to the present disclosure. Such processes can, for example, include a first melting by, but not limited to, vacuum induction melting (VIM) to produce castings of Ni-Ti-X alloys. Other primary melting processes may be employed including, but not limited to, induction skull melting, plasma melting, electron beam melting and vacuum arc melting. The castings may then be employed as electrodes in a VAR (Vacuum Arc Re-Melting) melting or ESR (Electroslag Remelting) processes or a combination of these processes.

According to a further aspect of the present disclosure, a semi-finished product is provided, comprising a Ni-Ti alloy, the alloy containing: between 55.75 and 57.0 wt % Ni, between 0.005 and 0.0220 wt % carbon, between 0.0001 and 0.0050 wt % nitrogen, between 0.0001 and 0.01 wt % aluminum, between 0.0001 and 0.01 wt % silicon, and between 0.0005 and 0.0220 wt % oxygen, the balance being titanium.

According to a further embodiment of the disclosure, the alloy used in the semi-finished product can have one or more of its constituting elements defined according to the following subranges: aluminum comprised between 0.001 and 0.01 wt %, silicon comprised between 0.0003 and 0.01 wt %, oxygen comprised between 0.005 and 0.0220 wt %.

EXAMPLE 1

Different alloys were VIM-VAR processed, forged and rolled to 6.3 mm coils and then drawn down to 0.3 mm wires. The chemistry of each alloys is provided in Table 1.

In particular, sample Si is an alloy made according to the teachings of the present disclosure, whereas samples C1-C2 are comparative examples.

TABLE 1

| Sample ID | Ni | O2 | N2 | C | Al | Si |
|---|---|---|---|---|---|---|
| S1 | 56.8 | 0.0205 | 0.0001 | 0.0205 | 0.0067 | 0.0054 |
| C1 | 55.82 | 0.0461 | 0.0006 | 0.0170 | 0.0170 | 0.0041 |
| C2 | 55.90 | 0.0262 | 0.0007 | 0.0260 | 0.0140 | 0.0046 |

EXAMPLE 2

The samples were examined at 500X magnification on a Zeiss Observer D1M inverted stage metallograph in the as-polished condition. In this condition, carbides intermetallic oxides, voids and matrix can be differentiated by color in the light microscope. After scanning, nine fields of view were photographed and analyzed on each sample. Size and area data were compiled for carbides and oxides separately for all particles at or above 0.1 μm in each of the nine fields of view. Data measured from the compositions of Table 1 are reported in Table 2.

TABLE 2

| Sample ID | Maximum Carbide size | Maximum area % Carbide | Maximum oxide size | Maximum area % Oxides |
|---|---|---|---|---|
| S1 | 15.49 | 0.51 | 5.73 | 0.05 |
| Cl | 15.46 | 0.71 | 22.57 | 0.75 |
| C2 | 11.36 | 0.98 | 34.41 | 1.94 |

It can be observed that sample S1, made according to the teachings of the present disclosure, presents enhanced characteristics with respect to comparative examples C1 and C2, which both have oxides with maximum dimensions above 20 μm. According to yet further embodiments of the disclosure, the sum of silicon, aluminum and oxygen is below 0.042 wt %, for example below 0.03 wt %.

As already mentioned above, semifinished products comprising the above described Ni- Ti alloy are also contemplated by the present disclosure. Such products can be shaped, for example, as tubes, wires, rods, bars and/or sheets.

The examples set forth above are provided to give those of ordinary skill in the art a complete disclosure and description of how to make and use the embodiments according to the disclosure, and are not intended to limit the scope of what the applicants regard as their disclosure. Modifications of the above-described modes for carrying out the disclosure may be used by persons of skill in the art, and are intended to be within the scope of the following claims. All patents and publications mentioned in the specification may be indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular devices, products, methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

The invention claimed is:

1. A Ni-Ti alloy containing: between 55.75 and 57.0 wt % nickel, between 0.005 and 0.0220 wt % carbon, between 0.0001 and 0.0050 wt % nitrogen, between 0.0001 and 0.01 wt % aluminum, between 0.0001 and 0.01 wt % silicon, and between 0.0005 and 0.0220 wt % oxygen, the balance being titanium, wherein the maximum size of inclusions of the alloy is 20 microns and the maximum area fraction of the inclusions is 1%.

2. The Ni-Ti alloy according to claim 1, wherein aluminum is comprised between 0.001 and 0.01 wt %.

3. The Ni-Ti alloy according to claim 1, wherein silicon is comprised between 0.0003 and 0.01 wt %.

4. The Ni-Ti alloy according to claim 1, wherein oxygen is comprised between 0.005 and 0.0220 wt %.

5. The Ni-Ti alloy according to claim 1, wherein the maximum size of the inclusions is 12.5 microns and the maximum area fraction of the inclusions is below 0.5%.

6. The Ni-Ti alloy according to claim 1, wherein the sum of silicon, aluminum and oxygen is below 0.042 wt %.

7. The Ni-Ti improved alloy according to claim 6, wherein the sum of silicon, aluminum and oxygen is below 0.03 wt %.

8. A semifinished product comprising the Ni-Ti alloy according to claim 1.

9. The semifinished product according to claim 8, wherein said semifinished product is a tube.

10. The semifinished product according to claim 8, wherein said semifinished product is a wire.

11. The semifinished product according to claim 8, wherein said semifinished product is a rod.

12. The semifinished product according to claim 8, wherein said semifinished product is a bar.

13. The semifinished product according to claim 8, wherein said semifinished product is a sheet.

14. A Ni-Ti alloy containing:

between 55.75 and 57.0 wt % nickel, between 0.005 and 0.0220 wt % carbon, between 0.0001 and 0.01 wt % aluminum, between 0.0001 and 0.01 wt % silicon, nitrogen and oxygen, the balance being titanium, wherein wt % of oxygen is four to five times wt % of nitrogen and wherein the maximum size of inclusions of the alloy is 20 microns and the maximum area fraction of the inclusions is 1%.

15. A semi-finished product comprising the Ni-Ti alloy of claim 14.

* * * * *